US011161665B2

(12) United States Patent
McDonald

(10) Patent No.: US 11,161,665 B2
(45) Date of Patent: Nov. 2, 2021

(54) CHILD RESISTANT DIAL PACK

(71) Applicant: Sonoco Development, Inc., Hartsville, SC (US)

(72) Inventor: Todd LaMont McDonald, Sycamore, IL (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 17/172,776

(22) Filed: Feb. 10, 2021

(65) Prior Publication Data

US 2021/0245944 A1 Aug. 12, 2021

Related U.S. Application Data

(60) Provisional application No. 62/972,350, filed on Feb. 10, 2020.

(51) Int. Cl.
*B65D 83/04* (2006.01)
*B65D 75/36* (2006.01)
*A61J 1/03* (2006.01)

(52) U.S. Cl.
CPC ..... *B65D 75/367* (2013.01); *A61J 1/035* (2013.01); *B65D 83/0454* (2013.01)

(58) Field of Classification Search
CPC ..... B65D 75/367; B65D 83/0454; A61J 1/035
USPC ..... 206/528, 530, 533, 538, 539; 221/90, 221/277
See application file for complete search history.

(56) References Cited

U.S. PATENT DOCUMENTS 4,164,301 A * 8/1979 Thayer ..... B65D 83/0454 206/534
4,261,468 A * 4/1981 Krebs ..... B65D 83/0454 206/538
5,322,166 A * 6/1994 Crowther ..... B65D 83/0454 206/534
5,762,199 A * 6/1998 Aguilera ..... B65D 83/0454 206/533
7,353,948 B1 4/2008 McDonald
10,479,566 B2 * 11/2019 Doyle ..... B65D 47/265
2005/0205595 A1 * 9/2005 Lepke ..... G07F 11/54 221/87
2008/0289989 A1 * 11/2008 Kalvelage ..... B65D 75/367 206/531
2009/0078606 A1 * 3/2009 Conley ..... A61J 7/0472 206/534
2010/0176020 A1 7/2010 Scarpy
2016/0325859 A1 * 11/2016 Kimmel ..... B29C 66/849

* cited by examiner

*Primary Examiner* — Luan K Bui
(74) *Attorney, Agent, or Firm* — von Briesen & Roper, s.c.

(57) ABSTRACT

A child resistant container comprising a tray and a cover is provided. The tray comprises a plurality of tray compartments arranged radially around a centrally disposed tray hub. Each tray compartment defines a cavity for holding one or more articles. The container is a "dial pack" type container, meaning the tray can be rotated with respect to the cover to expose each cavity in turn.

3 Claims, 6 Drawing Sheets

CHILD RESISTANT DIAL PACK

BACKGROUND

Field of the Invention

This patent relates to a child resistant container. More particularly, this patent relates to a blister type child resistant container for the pharmaceutical market and other markets.

Description of the Related Art

There are numerous child resistant packages on the market, some that are more effective than others. The present disclosure relates to a novel blister type child resistant package having a plurality of product compartments.

SUMMARY OF THE INVENTION

This disclosure relates to a blister type child resistant container for the pharmaceutical market and other markets. The container comprises a tray and a cover. The tray comprises a plurality of tray compartments arranged radially around a centrally disposed tray hub. Each tray compartment defines a cavity for holding one or more articles. The container is a "dial pack" type container, meaning the tray can be rotated with respect to the cover to expose each cavity in turn.

THE DRAWINGS

DETAILED DESCRIPTION OF THE INVENTION

Figure 1:
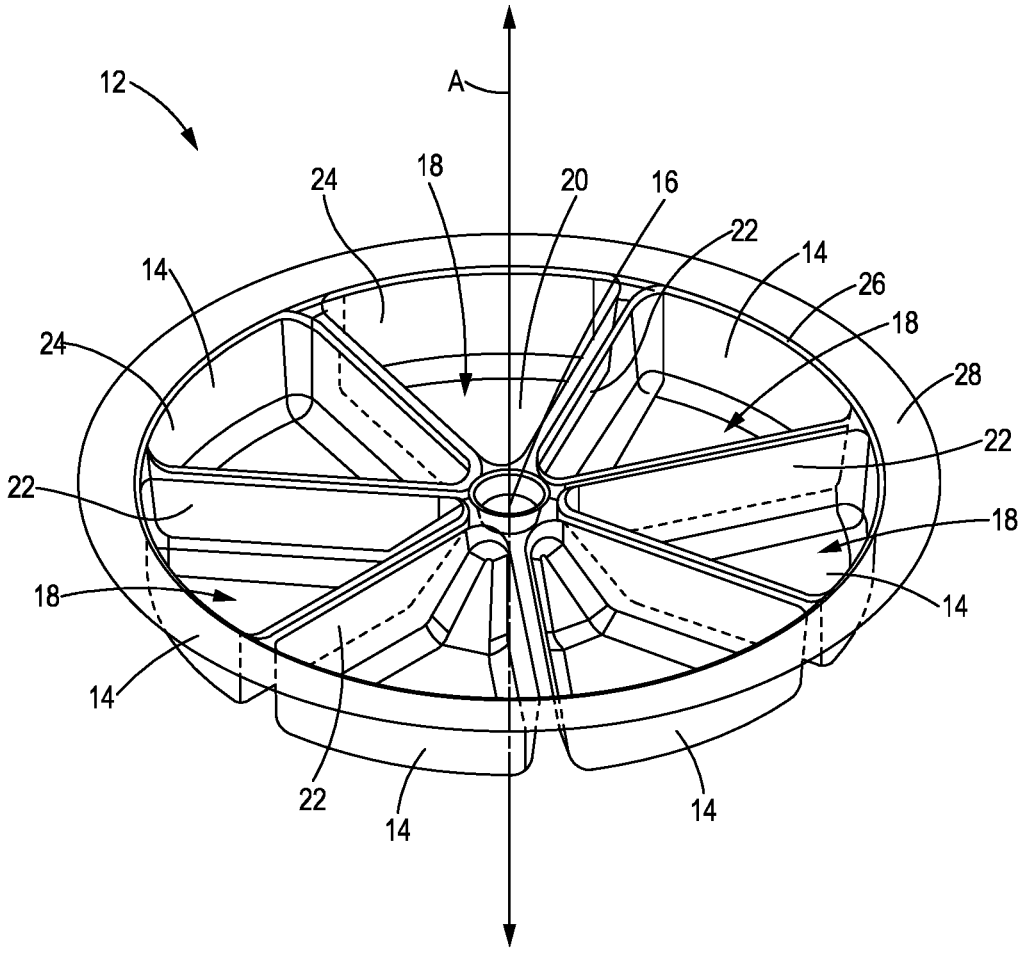
FIG. 1 is a perspective view of a tray used as a component of a container according to the disclosure.

While this disclosure may be embodied in many forms, there is shown in the drawings and will herein be described in detail one or more embodiments with the understanding that this disclosure is to be considered an exemplification of the principles of the disclosure and is not intended to limit the disclosure to the illustrated embodiments.

This disclosure relates to a blister type child resistant container for the pharmaceutical market and other markets. The container comprises a tray 12 and a cover 30.

Figure 2:
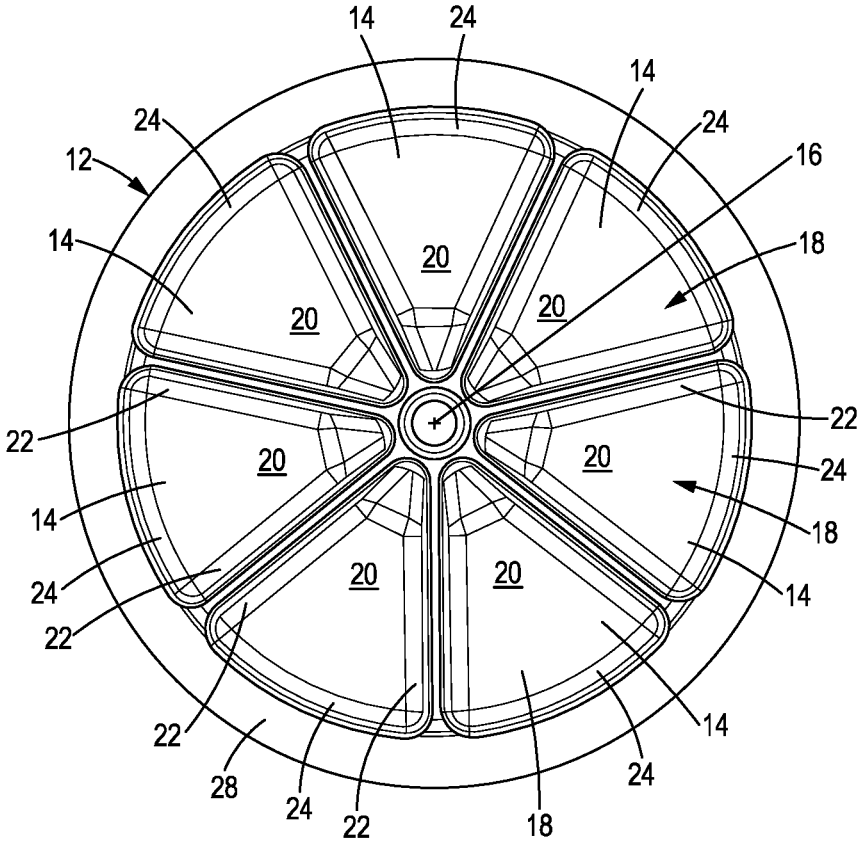
FIG. 2 is a top view of the tray of FIG. 1.
Figure 3:
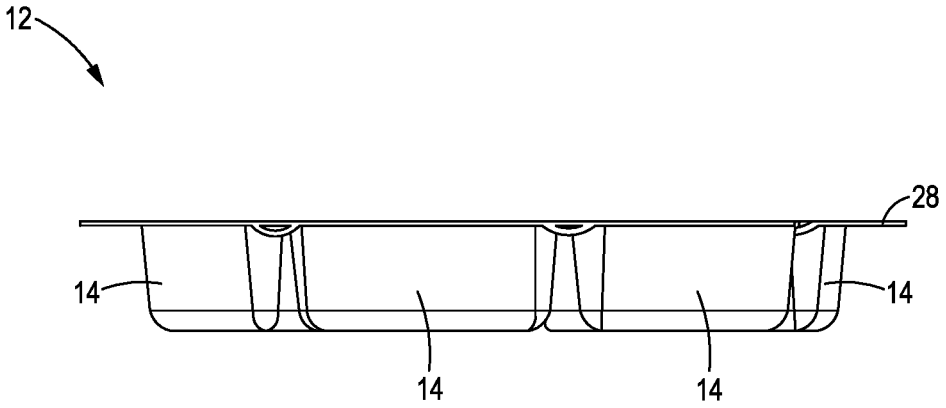
FIG. 3 is a side view of the tray of FIG. 1.

FIGS. 1 to 3 show one embodiment of a tray 12 used as a component of the container according to the disclosure. The tray 12 comprises a plurality of tray compartments 14 arranged radially around a centrally disposed tray hub 16. Each tray compartment 14 defines a cavity 18 for holding one or more articles. Each tray compartment 14 comprises a bottom wall 20, sidewalls 22 and an end wall 24 extending upward from the bottom wall 20 and terminating in top edges 26. A flange 28 may extend radially outward from the top edges 26 of the end walls 24. The compartments 14 may be pie shaped or any suitable shape. In the illustrated embodiment the tray compartments 4 are pie shaped with the apex of each pie being adjacent the tray hub 16. The pie shaped compartments 14 fit snugly together to form a disk or circular structure. The diameter of the circular structure, and thus the tray 12, may be larger than the grasp capability of a child, making it more difficult for a child to rotate the tray 12 with their hand. The bottom wall 20 of each compartment 14 may be inclined in whole or in part to make it easier to remove articles (not shown) from the compartment 14.

Figure 4:
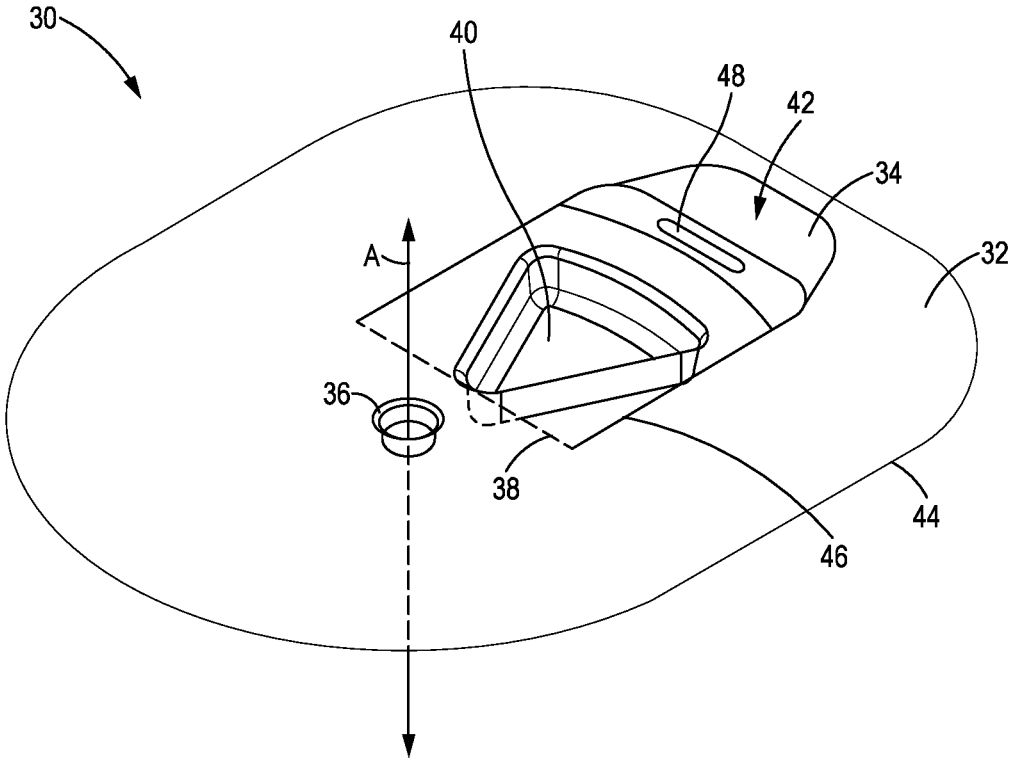
FIG. 4 is a perspective view of a cover used as a component of a container according to the disclosure.
Figure 5:
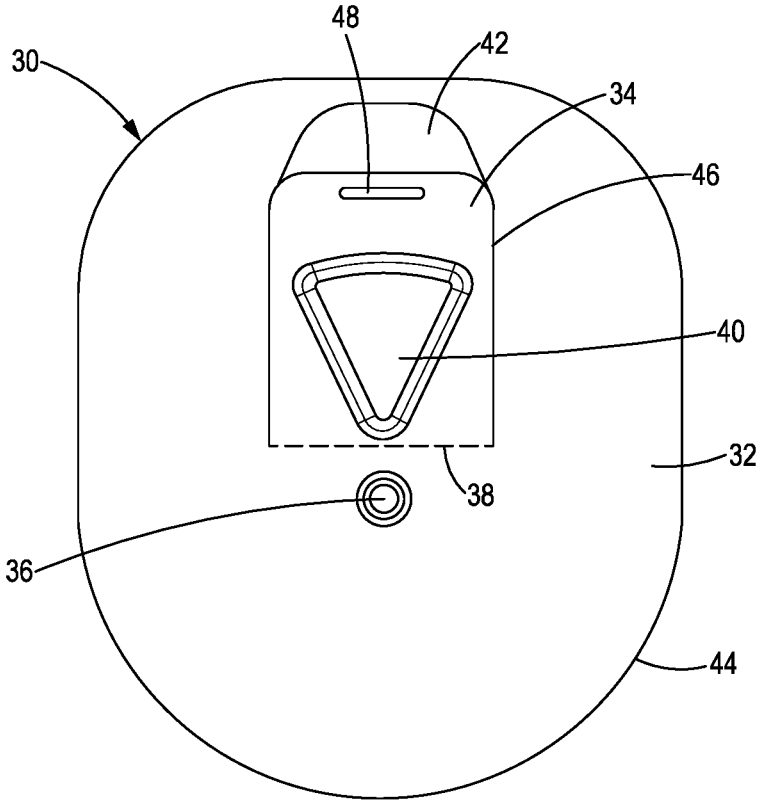
FIG. 5 is a top view of the cover of FIG. 4.
Figure 6:
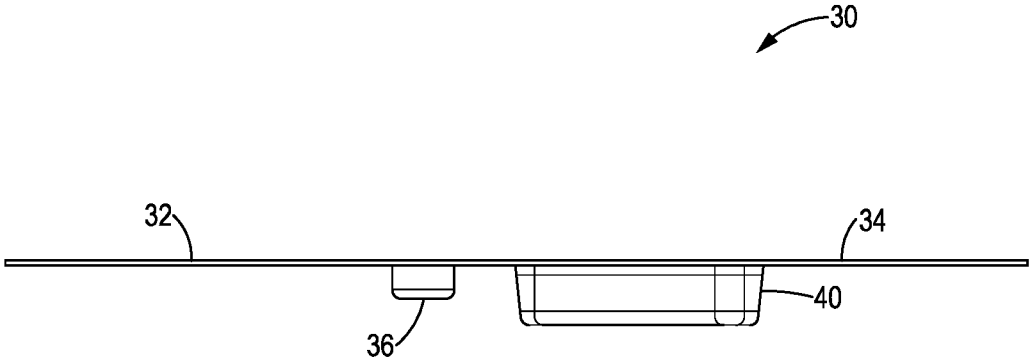
FIG. 6 is a side view of the cover of FIG. 4.

FIGS. 4 to 6 show one embodiment of a cover 30 used as a component of the container according to the disclosure. The cover 30 comprises a planar covering portion 32, a flap 34, a boss or protuberance 36 and a locking segment 40. The covering portion 32 may be configured to enclose one or more of the tray compartments 14. The boss 36 is configured to cooperate with the tray hub 16, such as in snap fashion, to join the cover 30 and the tray 12 in rotational engagement. The flap 34 may be hingedly attached to the covering portion 32 along a hinge line 38. The locking segment 40 extends downward from the flap 34 and is configured to cooperate with a tray compartment 14 to lock the tray 12 in a stationary (non-rotational) relationship with the cover 30 when the flap is in the closed (flat) position. The tray hub 16 and the boss 36 define a central axis (A). Together the covering portion 32 and the flap 34 may define a gap or finger opening 42 to make it easier for a user to lift the flap 34. The hinge line 38 may be defined by perforations or a score line. The flap 34 and the covering portion 32 may be made from (cut out of) a single piece of material that is die cut around the perimeter 44 of the cover 30 and also around the flap perimeter 46. The flap perimeter 46 may be U-shaped or any suitable shape. The flap 34 may define a slot or other opening 48 to accommodate, for example, a display hook.

The flap 34 is rotatable about the hinge line 38 between a first, closed position and a second, open position. In the closed position (shown in FIGS. 4 and 5) the flap 34 and the cover portion 32 are co-planar and the locking segment 40 is disposed within one of the tray compartment cavities 18, thereby preventing the rotation of the tray 12 with respect to the cover 30. In the open position the flap 34 is raised above the plane of the covering portion 32 and the locking segment 40 is raised above the tray compartment cavity 18 so that the tray 12 may be rotated with respect to the cover 30 about the central axis, thereby allowing access to the one or more articles within a tray compartment 14.

Each of the tray compartments 14 and the locking segment 40 have complimentary shapes. For example, each of the tray compartments 14 and the locking segment 40 may be pie shaped.

It is understood that the embodiments of the disclosure described above are only particular examples which serve to illustrate the principles of the disclosure. Modifications and alternative embodiments of the disclosure are contemplated which do not depart from the scope of the disclosure as defined by the foregoing teachings and appended claims. It is intended that the claims cover all such modifications and alternative embodiments that fall within their scope.

The invention claimed is:

1. A container comprising:

a tray comprising a plurality of tray compartments arranged radially around a centrally disposed tray hub, each tray compartment defining a cavity for holding one or more articles, each tray compartment comprising a bottom wall, sidewalls and an end wall extending upward from the bottom wall; and a cover comprising a stationary, planar covering portion, a flap and a boss, the covering portion configured to enclose one or more of the tray compartments, the boss configured to cooperate with the tray hub to join the cover and the tray in rotational engagement, the flap being hingedly attached to the covering portion along a hinge line and comprising a locking segment extending downward from the flap and configured to cooperate with a tray compartment to lock the tray in a stationary relationship with the cover, the tray hub and the boss define a central axis (A); wherein the flap is rotatable about the hinge line between a first, closed position in which the locking segment is disposed within a tray compartment cavity thereby preventing the rotation of the tray with respect to the cover, and an open position in which the locking segment is not disposed within a tray compartment cavity and the tray is rotatable with respect to the cover about the central axis thereby allowing access to the one or more articles within a tray compartment.

2. The container of claim 1 wherein each of the tray compartments and the locking segment have complimentary shapes.

3. The container of claim 1 wherein each of the tray compartments and the locking segment are pie shaped.

* * * * *